United States Patent [19]

Mechalas

[11] 4,351,373

[45] Sep. 28, 1982

[54] SYSTEM OF APPARATUS FOR FILLING BAGS WITH DRY POWDER

[76] Inventor: Emmanuel Mechalas, 2830 Townway, Danville, Ill. 61832

[21] Appl. No.: 157,350

[22] Filed: Jun. 9, 1980

[51] Int. Cl.[3] ..... B65B 1/16; B65B 31/02; B01F 7/04

[52] U.S. Cl. ..... 141/51; 141/59; 141/67; 141/89; 366/312; 406/172

[58] Field of Search ..... 55/302; 141/10–12, 141/51, 59, 89, 67, 68, 71, 316, 317; 366/312; 406/172

[56] References Cited

U.S. PATENT DOCUMENTS 3,707,172 12/1972 Obara ..... 141/68

*Primary Examiner*—Frederick R. Schmidt
*Attorney, Agent, or Firm*—Neal J. Mosely

[57] ABSTRACT

A system of apparatus for filling bags with dry powdered material and separating foreign matter therefrom includes a vacuum chamber for receiving a bag for filling with dry powder and a novel classifier for removing particulate foreign matter from the powder. The system includes a tank which is evacuated by a small vacuum pump and is connected to the enclosure where the bags are filled with powder and also is connected to a classifier which is provided for separating particulate foreign matter from the powder being bagged. The classifier is a rotary screen separator which discharges dry powder through the screen into a hopper connected to the bag filling enclosure. The classifier is connected to be maintained under vacuum on the outlet side during operation and is arranged to be connected to vacuum on the inlet side for back flushing to remove and recover particulate matter collected therein.

18 Claims, 6 Drawing Figures

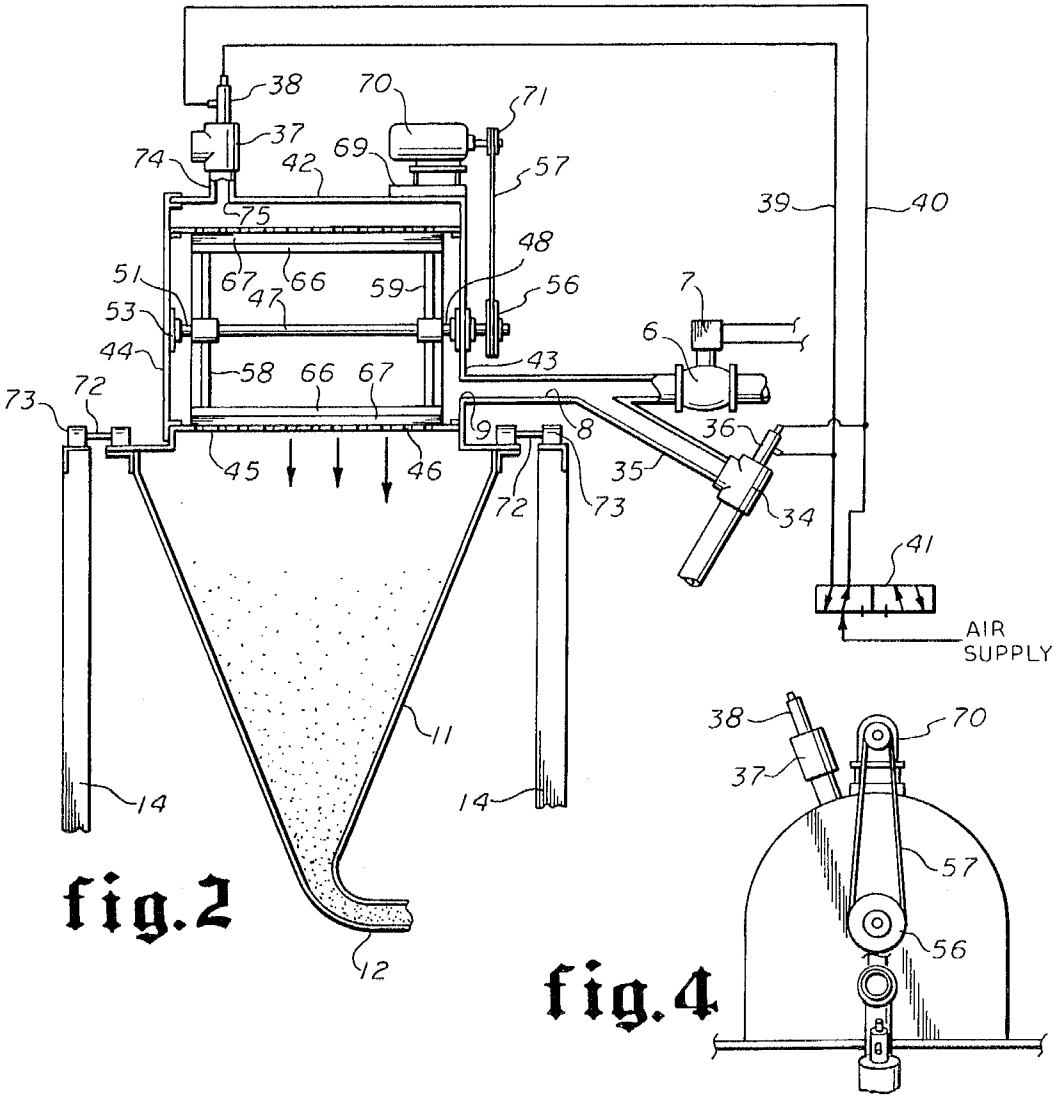
fig. 2
fig. 4
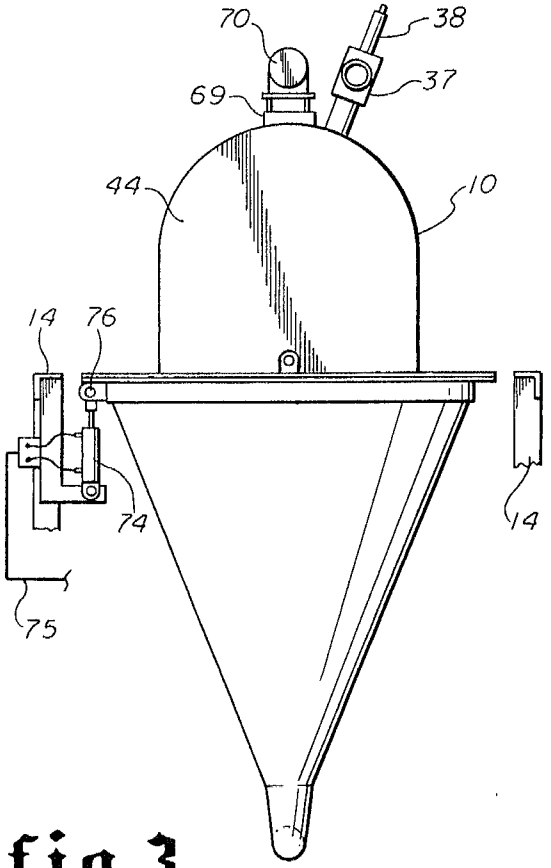
fig. 3

SYSTEM OF APPARATUS FOR FILLING BAGS WITH DRY POWDER

BACKGROUND OF THE INVENTION

1. Field of the Invention

This invention relates to new and useful improvements in apparatus for filling bags with dry powdered material and separating foreign matter therefrom prior to or during the filling operation.

2. Brief Description of the Prior Art

In the past, the filling of bags with powdered materials has presented certain problems in handling and particularly in the prevention of dust hazards and also in the separation of particulate contaminating materials.

In the handling of powdered materials for packaging by bagging it is necessary to avoid the release of dust into the packaging area to protect the workmen aganst unsafe working conditions. This has been accomplished to a limited extent by carrying out the bagging operation in an evacuated bagging chamber which allows the powdered material to fill a bag without being released to the surrounding area. Dust hazard has also been reduced in some cases by providing air circulation in the bagging area and carrying the dust through a suitable filter or dust collector or separator.

The problem of separating particulate foreign matter or clumps of the powdered material from a powder being bagged has presented a substantial problem. Conventionally, this is done in a batch operation prior to bagging the powdered material and is productive of a substantial amount of dust in the working area.

As a result, there has been a substantial need for a simple and efficient system apparatus for filling bags with dry powdered material and separating foreign matter therefrom on a continuous basis while maintaining a substantially dust-free working environment.

SUMMARY OF THE INVENTION

One of the objects of this invention is to provide a new and improved system of apparatus for filling bags with powdered material.

Another object of this invention is to provide improved system of apparatus for filling bags for powdered material including means for continuously screening particulate contaminating material therefrom.

Another object of this invention is to provide an improved system of apparatus for filling bags with powdered material which is operated under vacuum for increased operating efficiency and reduced dust hazard.

Still another object of this invention is to provide a new and improved system of bag filling apparatus having an improved continuous rotary screen separator which is operated under vacuum and provided with a system for back flushing the separator screen.

Another object of this invention is to provide an improved system of apparatus for filling bags with dry powder which has a rotary separator and classifier supported for oscillating pivotal movement to facilitate flow of screened powder to the bag filler.

Still another object of this invention is to provide a new and improved hopper and screen separator unit for use in a bag filling system.

Other objects and features of this invention will become apparent from time to time throughout the specification and claims as hereinafter related.

A system of apparatus for filling bags with dry powder and separating foreign matter therefrom which accomplishes the aforementioned objectives is described herein.

A system of apparatus for filling bags with dry powdered material and separating foreign matter therefrom includes a vacuum chamber for receiving a bag for filling with dry powder and a novel classifier for removing paticulate foreign matter from the powder. The system includes a tank which is evacuated by a small vacuum pump and is connected to the enclosure where the bags are filled with powder and also is connected to a classifier which is provided for separating particulate foreign matter from the powder being bagged. The classifier is a rotary screen separator which discharges dry powder through the screen into a hopper connected to the bag filling enclosure. The classifier is connected to be maintained under vacuum on the outlet side during operation and is arranged to be connected to vacuum on the inlet side for back flushing to remove and recover particulate matter collected therein.

BRIEF DESCRIPTION OF THE DRAWINGS

FIG. 2 is a view, partially in section, of the hopper and rotary screen separator or classifier shown in the system of apparatus illustrated in FIG. 1.

FIG. 3 is a view in left-end elevation of the hopper and rotary screen separator shown in FIG. 2.

FIG. 4 is a view in right-end elevation of the rotary screen separator shown in the upper part of FIG. 2.

DESCRIPTION OF THE PREFERRED EMBODIMENT

Figure 1:
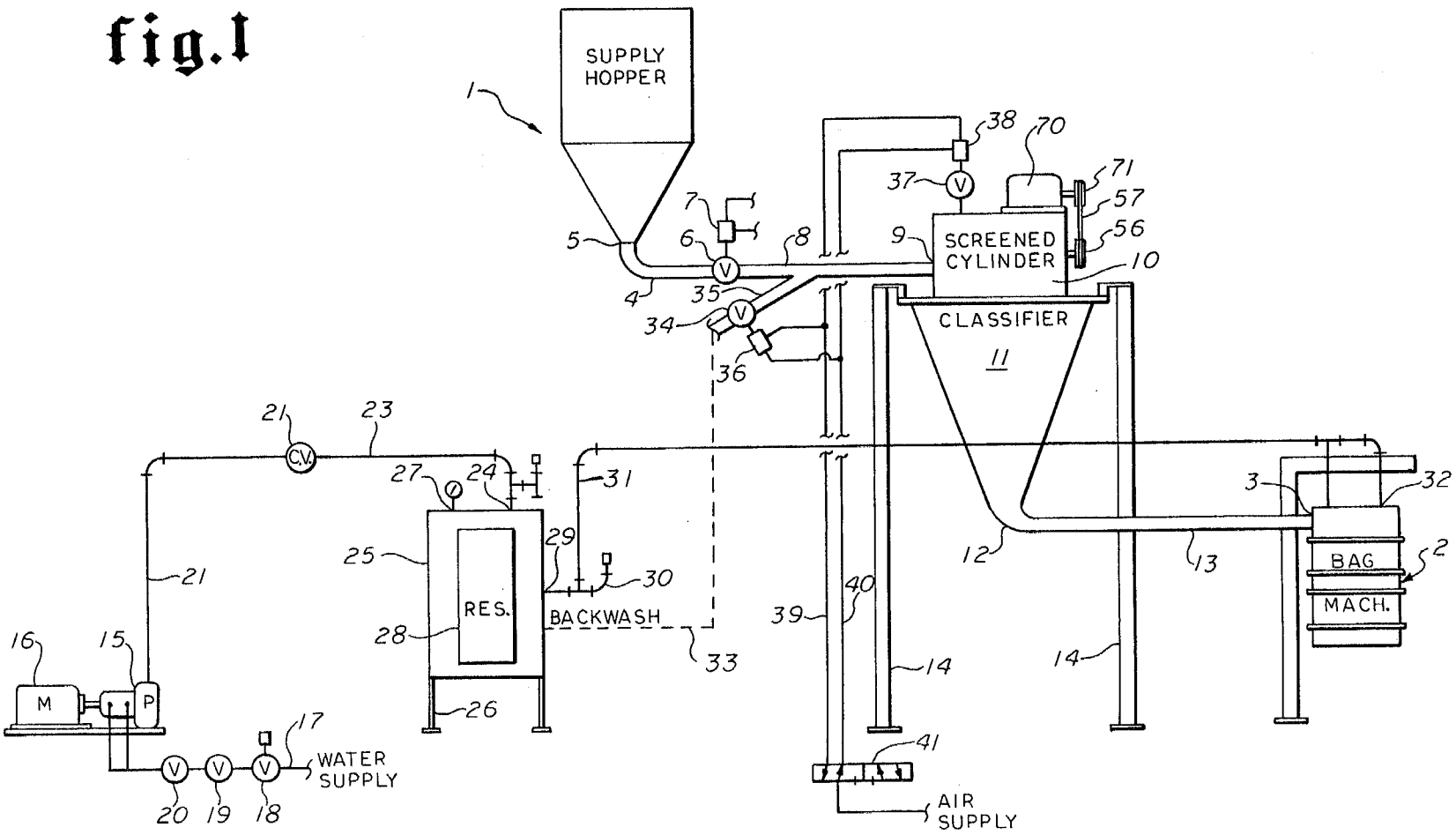
FIG. 1 is a schematic view of a novel system of apparatus for filling bags with dry powdered material and separating foreign matter therefrom which comprises a preferred embodiment of this invention.

Referring to the drawings by numerals of reference and more particularly to FIG. 1, there is shown a system of apparatus for filling bags with powdered material in which the powdered material is continuously screened to remove foreign particulate material. The system includes a supply hopper 1 for supplying dry powdered material which is to be bagged in a bagging machine 2. Bagging machine 2 is an air-tight enclosure having an inlet opening 3 for introduction of powdered material to bag filling nozzles, not shown, to which there are connected bags into which the powdered material is deposited. The bagging machine or hollow enclosure 2 is subjected to a continuous vacuum as will be subsequently described.

The powdered material flows through conduit 4 which extends from the bottom end 5 of supply hopper 1 to control valve 6 which is preferably a pneumatically operated control valve operated by a pneumatic operator 7. The other side of valve 6 is connected to conduit 8 which extends to the inlet 9 to a rotary separator 10 which will be described more fully hereafter and is shown in more detail in FIG. 2. Rotary separator 10 is supported on top of classifier hopper 11 which has its bottom end or outlet portion 12 connected to conduit 13 extending to the inlet 3 of the bagging machine enclosure 2. The rotary separator 10 and hopper 11 are preferably supported for oscillating pivotal movement on supporting frame 14.

The system of apparatus shown in FIG. 1 includes an evacuation system for applying vacuum to bagging machine enclosure 2 and to classifier hopper 11 and also to apply vacuum to the inlet side of rotary separator 10 for back flushing. The evacuation system consists of a vacuum pump 15 driven by motor 16. The vacuum pump is connected to water supply 17 and is controlled by control valve 18 and shutoff valves 19 and 20. Vacuum pump 15 is connected by conduit 21 to control valve 22 and thence by conduit 23 to the upper end inlet 24 to a reservoir or vacuum tank 25. Reservoir or tank 25 is supported on legs 26 and also includes a pressure gauge 27 at the top indicating the level of vacuum. Tank or reservoir 25 has a door 28 for access for cleaning.

Vacuum tank or reservoir 25 is connected through conduit 29 to vacuum regulator 30 and to conduit 31 which is connected to the upper end of bagging machine enclosure 2 as indicated at 32. Vacuum tank 25 is also connected by conduit 33 to valve 34 which is connected to a branch conduit 35 opening to conduit 8 at a point between control valve 6 and the inlet opening 9 to the rotary screen separator 10. Control valve 34 is a pneumatic valve controlled by pneumatic operator 36. At the top of rotary separator 10 there is provided a control valve 37 operated by pneumatic operator 38. Pneumatic operators 36 and 38 are controlled by air supply lines 39 and 40 which are controlled by an air pressure switch or valve 41.

Figure 5:
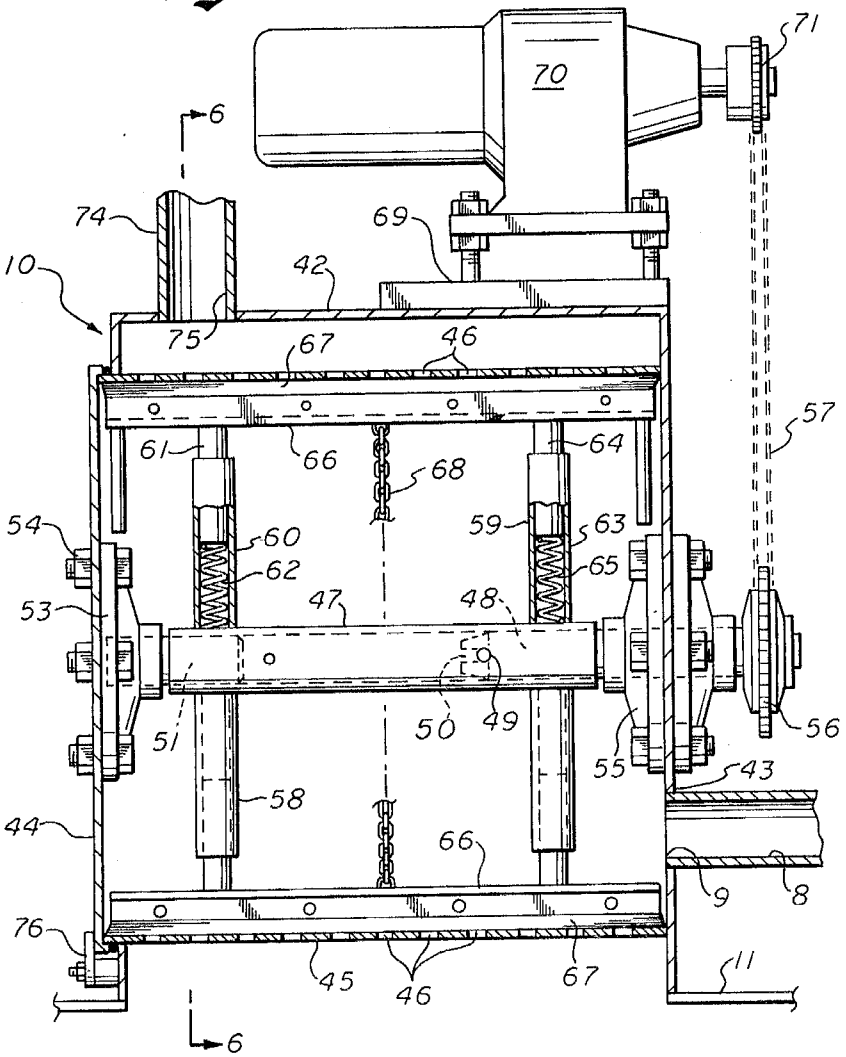
FIG. 5 is an enlarged view in longitudinal central section of the rotary separator seen in the upper portion of FIG. 2.
Figure 6:
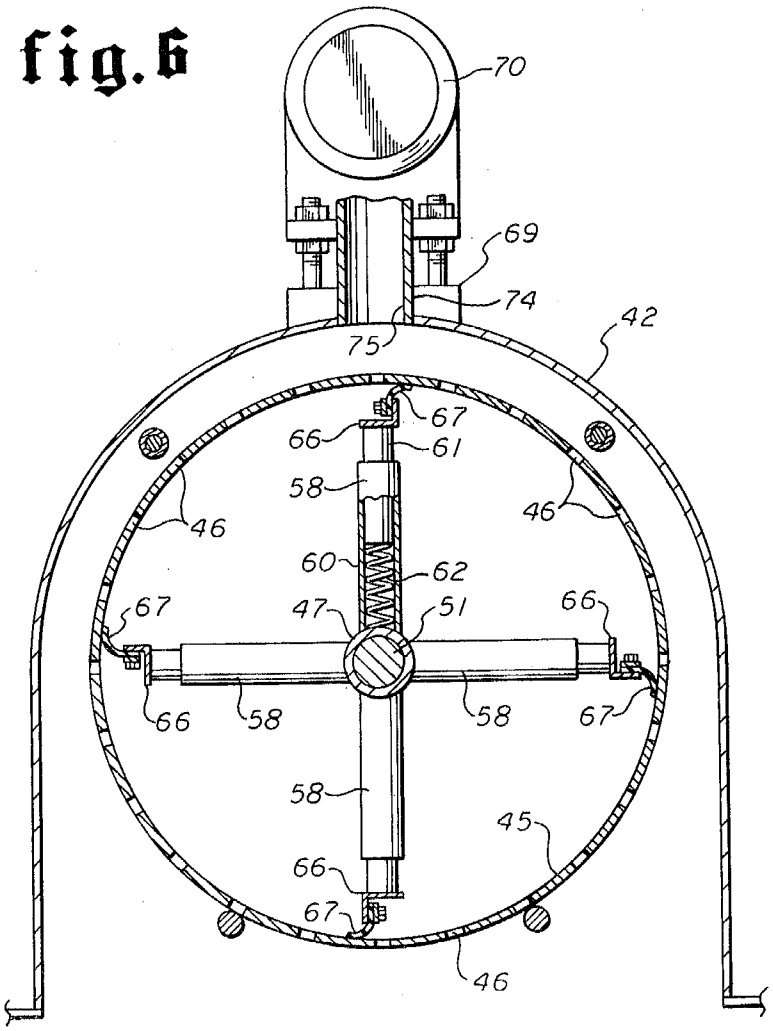
FIG. 6 is a sectional view of the rotary separator taken on the line 6—6 of FIG. 5.

In FIGS. 2 to 6, the rotary separator is shown in more detail. Rotary separator 10 consists of an outer housing 42 which is supported on tapered hopper II as seen in FIGS. 4 and 5. Housing 42 includes a fixed end wall 43 and a removable end wall or panel 44. Within housing 42 there is supported a cylindrical wall member 45 which is of perforate construction or which may be a metal screen, if desired. Cylindrical wall 45 has a plurality of minute openings 46 which are of the size permitting the powdered material to pass through into classifier hopper 11 while retaining contaminating particulate matter on the cylindrical wall. The interior of rotary separator 10 is subjected to vacuum through the connection of outlet 12 to conduit 13 which opens into evacuating bagging enclosure 2.

Inside rotary separator 10 there is provided a system of rotary wiping blades for sweeping the powdered material being handled along the surface of perforate screen wall 45 to facilitate the sifting of powdered material therethrough. The rotary wiper blade mechanism consists of hollow cylindrical axle 47 which is supported on one end on rotary shaft 48 with a pin 49 in slot 50 construction for causing axle 47 to rotate with stub shaft 48. The other end of axle 47 is supported on stub shaft 51 which is supported on supporting plate 53 which is secured by a plurality of bolts 54 on removable end wall 44. Rotary stub shaft 48 is supported in a rotary bearing 55 supported on fixed end wall 43. The outer end of rotary stub shaft 48 is provided with a sprocket gear 56 which is arranged to be driven by a chain drive 57.

Axle 47 has supported thereon a plurality of radially extending spokes 58 at one end and a plurality of radially extending spokes 59 at the other end. Radially extending spokes 58 consists of a hollow sleeve 60 having a piston 61 supported therein for longitudinal movement and urged outward by a coil spring 62. Spokes 59 likewise consists of a hollow sleeve 63 having a radially or longitudinally extendable piston 64 therein which is urged outward by coil spring 65. The outer ends of pistons 61 and 64 support the cross pieces 66 which support rubber wiper blades 67. Axle 47 is designed to be rotated by sprocket gear 56 to rotate radially extending arms 58 and 59 to move wiper blades 67 along the inner surface of cylindrical perforate wall 45 to agitate the powdered material being handled and to wipe the powdered material continuously along perforate openings 46 to cause the powder to sift through and retain any larger particulate matter on the screen wall. Springs 62 and 65 permit pistons 61 and 64 and cross piece 66 supported thereon to be moved radially inward during assembly or disassembly of the apparatus. When the apparatus is in the form shown in FIGS. 5 and 6, the springs 62 and 65 press the wiper blades 67 out into contact with perforate cylindrical wall 45. Cross pieces 66 which support wiper blades 67 are interconnected by a pair of chains 68 which connect the diametrically opposed cross pieces or supports 66. Chains 68 are of a length permitting the full extension of pistons 61 and 64 to allow wiper blades 67 full contact with cylindrical perforate wall 45. Chains 68, however, may be pulled toward the end of axle 47 and will cause cross pieces 66 to be drawn together against the force of springs 62 and 65 to allow the rotary wiping blade assembly to be removed or installed as an integral unit.

On the upper wall of housing 42 of rotary separator 10, there is provided a supporting bracket 69 on which there is supported an electric motor 70. Motor 70 is provided with a drive sprocket 71 which drives the other end of drive chain 57 for rotating sprocket 56 to rotate the wiper blade assembly inside cylindrical perforate wall 45. While the drive mechanism is shown as a sprocket and chain drive, it obviously could have a pulley and belt drive if desired.

The unit consisting of classifier hopper 11 and rotary screen separator 10 is supported by pivotal supporting arms 72 on pivot supports 73 on the upper end of supporting frame 14. The entire structure can be pivoted back and forth on pivot supports 72 in an oscillating manner to facilitate feeding the powdered material from hopper 11 through conduit 12 to bag filling apparatus 2. Supporting frame 14 supports a pneumatic actuator 74 supplied from a suitable source of compressed air 75. Actuator 74 is operatively connected as indicated at 76 to the supporting frame for hopper 11 and rotary classifier 10. Pneumatic actuator 74 may be reversibly operated to cause the hopper 11 and rotary separator 10 to pivot back and forth on pivot supports 72.

OPERATION

The operation of this equipment should be fairly obvious from the description of the component parts and the mode of assembly but will be described somewhat further to avoid possible misunderstanding.

The purpose of this system of apparatus is to remove foreign objects from a powder-type material while supplying the powder to a bagging machine. The powder material is drawn under vacuum through a cylindrical screen as previously described.

The powder being handled is first introduced into supply hopper 1 for ultimately being packaged or bagged by bagging machine 2. Vacuum pump 15 draws a vacuum on vacuum tank or reservoir 25 which supplies vacuum to bagging machine enclosure 2. The vacuum from enclosure 2 is applied through conduit 13 to classifier hopper 11 and to the rotary separator 10. In this apparatus, essentially the complete system is under vacuum. The powdered material passes into the interior of rotary screen separator 10 through conduit 8 and inlet opening 9. Inside rotary screen separator 10, the powdered material is agitated by the rotary movement of wiper blades 67 along the cylindrical perforate wall 45. The powdered material filters through the perforate openings 46 under the influence of vacuum and is collected in tapered classifier hopper 11 and drawn out through outlet opening 12 and conduit 13 to enclosure 2 where it is introduced into a bag under vacuum. The feeding of the powdered from classifier hopper 11 to bag machine enclosure 2 is facilitated by the reciprocal or oscillating pivotal movement of hopper 11 and rotary screen separator 10 on pivotal support 72.

From time to time, it is necessary to back flush the rotary separator 10 to remove particulate material which has collected on cylindrical perforate screen wall 45. When this is done, valve 6 is closed to cut off flow of powder from supply hopper 1. Valve 34 on conduit 35 is opened. Valve 37 on conduit 74 extending from opening 75 is also opened. The opening of valve 37 permits air from outside the apparatus to flow into rotary separator in the space around cylindrical perforate screen wall 45. Valve 6 is closed cutting off the flow of powder. Valve 34 is open which causes vacuum to be applied to the interior of cylindrical screen wall 45 so that air is drawn backward through the apparatus flushing out material which has been collected on the screen wall 45 and carrying it back into reservoir or tank 25. In this phase of the operation, the vacuum tank 25 functions as a reservoir for a vacuum cleaner to remove the particulate material or thrash collected in the rotary separator.

For ease of maintenance, removable end panel or door 44 can be removed by releasing retaining bracket 76. The removal of door or panel 44 allows shaft 51 to be pulled out of hollow shaft or axle 47. The paddle or wiper blade assembly can be pulled out separating itself from stub shaft 48 which is also connected to sprocket 56. When the paddles or wiper blades have been removed, it is possible to remove cylindrical screen 45 for cleaning or maintenance. Pulling on chains 68 causes springs 62 and 65 to become compressed so that the wiper blades are drawn together which permits easy removal or reinstallation of the wiper blade assembly inside screen wall 45.

While this invention has been described fully and completely with special emphasis upon a single preferred embodiment, it should be understood that within the scope of the appended claims the invention may be practiced otherwise than as specifically described herein.

I claim:

1. A system of apparatus for filling bags with dry powdered material and separating foreign matter therefrom comprising an air tight enclosure for receiving a bag for filling with a dry powder, vacuum producing means connected to said enclosure for evacuating the same, means for storing and supplying a dry powder to said enclosure, a classifier operatively connected to said storage means to receive powder therefrom and operatively connected to said enclosure to supply powder thereto with foreign matter separated therefrom, said classifier, comprising a screen separator positioned to receive said dry powder and separate foreign matter of a size greater than the powder, means connecting said vacuum producing means to said classifier to maintain the same under vacuum during operation, and means connecting said vacuum producing means to said classifier in a reversed relation and operable to backflush said screen separator to remove particulate matter collected thereon.

2. A system according to claim 1 in which said vacuum producing means comprises a vacuum tank and a vacuum pump connected thereto for evacuating the same, and said vacuum tank being connected to said enclosure and to said classifier.

3. A system according to claim 2 in which said classifier comprises a separating hopper having an outlet operatively connected to said enclosure and a rotary screen separator positioned to receive powder from said storage means and to discharge powder to said hopper, and said rotary screen separator having one surface exposed to vacuum in said enclosure and another surface adapted to be exposed to vacuum in said vacuum producing means when connected to said reverse relation.

4. A system according to claim 3 in which said rotary screen separator is supported on said hopper and including means to support said separator and hopper for pivotal movement, and means to pivot said separator and hopper in an oscillating movement to facilitate the flow of powder to said enclosure.

5. A system according to claim 4 in which said supporting means comprises a supporting frame having pivotal support points, said hopper includes pivotal support members supported on said frame, and said pivoting means comprises a pneumatic actuator.

6. A system according to claim 3 in which said means connecting said vacuum producing means in reversed relation comprises conduit means connected from said vacuum tank to the inlet side of said screen separator having a normally closed valve, an outlet opening positioned on the outlet side of said screen separator and a normally closed valve controlling said opening, and said valves being operable upon opening to effect a back flow of air through said screen separator to backflush the same and remove particulate matter collected therein.

7. A system according to claim 3 in which said rotary separator comprises a cylindrical perforate or screen wall supported above said hopper, a rotatable wiping blade supported inside said cylindrical wall for rotary wiping engagement therewith, means for rotating said rotary blade within said cylindrical wall, and said storage means being connected to said separator to supply powder to the interior of said cylindrical wall.

8. A system according to claim 7 in which said rotatable wiping blade comprises a rotary shaft having a plurality of pairs of radially extending supports, a wiping blade supported on each pair of radially extending supports, each of said radially extending supports being of two piece telescoping construction including a spring urging the piece supporting said wiper blade outward so that each wiper blade is supported under spring compression against said cylindrical perforate or screen wall.

9. A system according to claim 3 in which said storage means is a supply hopper operatively connected to said separator and including a control valve for controlling the flow of powder thereto.

10. An apparatus for separating foreign matter from a dry powder for feeding to a bag filling apparatus comprising, a classifier adapted to be connected to dry powder storage means to receive powder therefrom and to be connected to a bag filling enclosure to supply powder thereto with foreign matter separated therefrom, said classifier comprising a screen separator positioned to receive said dry powder and separate foreign matter of a size greater than the powder, vacuum producing means operatively connected to said classifier to maintain the same under vacuum during operation, and means connecting said vacuum producing means to said classifier in a reversed relation and operable to backflush said screen separator to remove particulate matter collected thereon.

11. An apparatus according to claim 10 in which said vacuum producing means comprises a vacuum tank and a vacuum pump connected thereto for evacuating the same, and said vacuum tank being connected to said classifier and adapted to be connected to the bag filling enclosure with which the apparatus is to be used.

12. An apparatus according to claim 11 in which said classifier comprises a separating hopper having an outlet adapted to be connected to a bag filling enclosure and a rotary screen separator positioned to receive powder from said storage means and to discharge powder to said hopper, and said rotary screen separator having one surface adapted to be exposed to vacuum in said bag filling enclosure and another surface adapted to be exposed to vacuum in said vacuum producing means when connected in said reverse relation.

13. An apparatus according to claim 12 in which said rotary screen separator is supported on said hopper and including means to support said separator and hopper for pivotal movement, and means to pivot said separator and hopper in an oscillating movement to facilitate the flow of powder to said bag filling enclosure.

14. An apparatus according to claim 13 in which said supporting means comprises a supporting frame having pivotal support points, said hopper includes pivotal support members supported on said frame, and said pivoting means comprises a pneumatic actuator.

15. An apparatus according to claim 12 in which said means connecting said vacuum producing means in reversed relation comprises conduit means connected from said vacuum tank to the inlet side of said screen separator having a normally closed valve, an outlet opening positioned on the outlet side of said screen separator and a normally closed valve controlling said opening, and said valves being operable upon opening to effect a back flow of air through said screen separator to backflush the same and remove particulate matter collected therein.

16. An apparatus according to claim 12 in which said rotary separator comprises a cylindrical perforate or screen wall supported above said hopper, a rotatable wiping blade supported inside said cylindrical wall for rotary wiping engagement therewith, means for rotating said rotary blade within said cylindrical wall, and said storage means being connected to said separator to supply powder to the interior of said cylindrical wall.

17. An apparatus according to claim 16 in which said rotatable wiping blade comprises a rotary shaft having a plurality of pairs of radially extending supports, a wiping blade supported on each pair of radially extending supports, each of said radially extending supports being of two piece telescoping construction including a spring urging the piece supporting said wiper blade outward so that each wiper blade is supported under spring compression against said cylindrical perforate or screen wall.

18. An apparatus according to claim 12 in which said storage means is a supply hopper operatively connected to said separator and including a control valve for controlling the flow of powder thereto.

* * * * *